US008221077B2

(12) United States Patent
Pelshak et al.

(10) Patent No.: US 8,221,077 B2
(45) Date of Patent: Jul. 17, 2012

(54) MODULAR FAN BLADE WITH COMBINED ELECTRICAL AND MECHANICAL CONNECTION SYSTEM

(75) Inventors: Mark Pelshak, Morrisville, NC (US); Henri Hudson, Raleigh, NC (US); Anand Paleja, Raleigh, NC (US); Rodger Seabrooks, Holly Springs, NC (US)

(73) Assignee: Fatchdato, LLC, Morrisville, NC (US)

( * ) Notice: Subject to any disclaimer, the term of this patent is extended or adjusted under 35 U.S.C. 154(b) by 463 days.

(21) Appl. No.: 12/587,785

(22) Filed: Oct. 13, 2009

(65) Prior Publication Data

US 2011/0085908 A1 Apr. 14, 2011

(51) Int. Cl.
*F04D 29/00* (2006.01)

(52) U.S. Cl. ..... 416/5; 416/62; 416/210 R

(58) Field of Classification Search ..... 416/5, 62, 416/210 R, 207, 209, 244 R
See application file for complete search history.

(56) References Cited

U.S. PATENT DOCUMENTS

| | | | | |
|---|---|---|---|---|
| 1,747,433 | A * | 2/1930 | Genest | 40/441 |
| 5,028,206 | A * | 7/1991 | Kendregan et al. | 416/5 |
| 5,072,341 | A * | 12/1991 | Huang | 362/96 |
| 5,082,422 | A * | 1/1992 | Wang | 416/5 |
| 5,437,540 | A * | 8/1995 | Blocker et al. | 416/5 |
| 6,036,331 | A * | 3/2000 | Acquisto | 416/5 |
| 8,100,649 | B2 * | 1/2012 | Okimura | 416/5 |

* cited by examiner

*Primary Examiner* — Igor Kershteyn
(74) *Attorney, Agent, or Firm* — J. Wiley Horton

(57) ABSTRACT

A fan blade assembly having both an electrical connection and a mechanical connection to a rotating hub. The assembly is configured so that a single installation motion creates the mechanical connection and the electrical connection. The electrical connection preferably includes multiple independent conductor paths.

20 Claims, 9 Drawing Sheets

MODULAR FAN BLADE WITH COMBINED ELECTRICAL AND MECHANICAL CONNECTION SYSTEM

BACKGROUND OF THE INVENTION

1. Field of the Invention

This invention relates to the field of ceiling fans. More specifically, the invention comprises a modular fan blade design with a connection system allowing the mechanical and electrical engagement of the blade with the hub to be accomplished in a single installation motion.

2. Description of the Related Art

Ceiling fans have been in common use for many decades. Recent advances in display technology have allowed traditional ceiling fans to assume a new role. Arrays of display devices—such as light emitting diodes—have been provided on the downward facing surfaces of the fan blades. These display devices are connected to a controlling computing device which illuminates them in a defined sequence. Because the fan blades are revolving at a stable speed, the human phenomenon knows as "persistence of vision" can be exploited to create entertaining patterns and even well-defined images.

As the user looks up toward the fan, he or she will not perceive the individual sequencing of the display devices but will instead perceive a unified pattern. The controlling software can implement a virtually endless variety of visual effects. The software can also implement simple lighting patterns to provide a pleasing atmosphere.

One application for a fan incorporating this display technology is a home theater setting where the display devices can be synchronized with music or video. The display can pulse in time with the music or other sounds and provide pleasing color changes and patterns. The display can even present a video image which is preferably synchronized with the music and/or video.

The use of the fan blades for lighting display purposes introduces challenges which were not known in the field of traditional ceiling fans. Fans have always had some sort of mechanical connection between the blades and the hub, but did not need an electrical connection. Display devices need multiple electrical connections, especially if complex patterns are to be displayed. This has typically required a series of separate electrical connections to be made after the mechanical attachment of the blades to the hub has been made.

It is also known to use a revolving "fan" assembly as a form of low frequency audio transducer. Such fans are provided with variable pitch blades, roughly analogous to those found in a helicopter. When the pitch of the revolving blades is abruptly increased, a pressure wave is created. This approach has not been used in relatively large fans, such as ceiling fans. However, the present inventors are seeking to apply this approach to ceiling fans.

The use of a ceiling fan as a low frequency audio transducer is only practical for relatively low frequencies. This can be acceptable in some applications, however. Again using the home theater example—other speakers are often available to produce the medium and higher frequencies. A revolving ceiling fan is well-suited to this application when it is complementing existing conventional speakers. Some or all of the conventional speakers may optionally be mounted in the hub as well.

Thus, the reader will perceive that in addition to the desired mechanical and electrical connection of the blade to the hub, it is desirable to provide a connection which is compatible with rapid pitch variance of the blade. The inventors propose such a device in the following description.

BRIEF SUMMARY OF THE PRESENT INVENTION

The present invention comprises a fan blade assembly having both an electrical connection and a mechanical connection to a rotating hub. The assembly is configured so that a single installation motion creates the mechanical connection and the electrical connection. The electrical connection preferably includes multiple independent conductor paths. The invention preferably includes conventional electrical components so that no new tooling is needed.

The resulting combined mechanical and electrical connection is strong and vibration resistant. It is able to withstand cyclic pitching forces which occur when the rotating blades are used as a low frequency audio transducer.

REFERENCE NUMERALS IN THE DRAWINGS

| | | | |
|---|---|---|---|
| 10 | blade assembly | 12 | blade body |
| 14 | display pocket | 16 | display board |
| 18 | display element | 20 | female connector |
| 21 | driver | 22 | yoke |
| 24 | connector receiver | 26 | pocket |
| 28 | receiver | 30 | wing |
| 32 | through hole | 34 | through hole |
| 35 | notch | 36 | lock pin |
| 38 | stem assembly | 40 | mounting plate |
| 42 | mounting hole | 44 | contact |
| 46 | drop arm | 48 | mating bar |
| 50 | male connector | 52 | cross latch |
| 54 | cross latch hole | 58 | hollow interior |
| 60 | latch guide | 62 | wire |
| 64 | pitch joint | 66 | pitch actuator |
| 68 | ball joint | | |

DETAILED DESCRIPTION OF THE INVENTION

Figure 1:
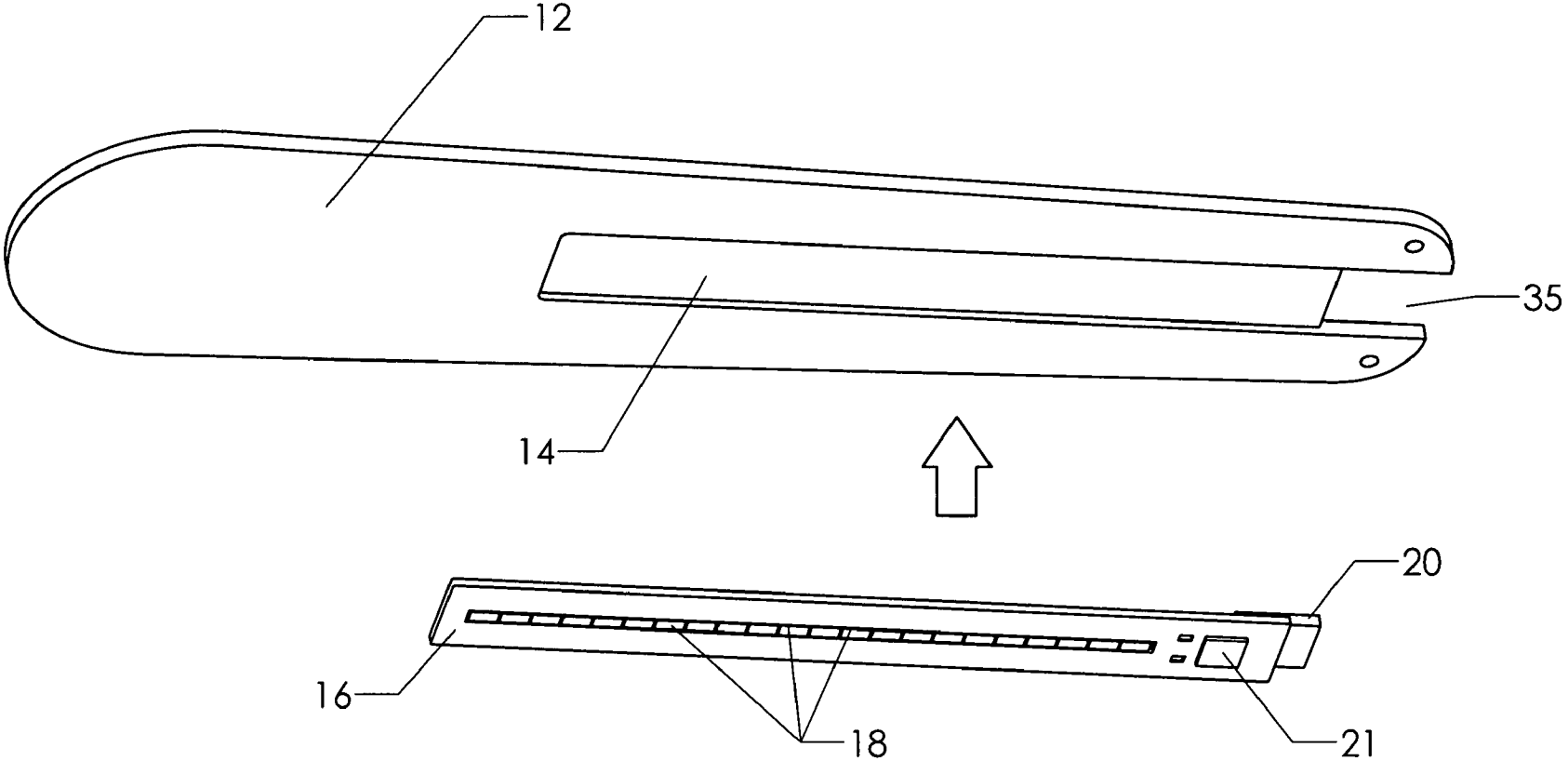
FIG. 1 is a perspective view, showing a fan blade with an associated display board.

FIG. 1 is an exploded perspective view of a fan blade constructed according to the present invention. Blade body 12 is an elongated thin object having a tip and an opposite end which will be located closest to the fan's hub (the "hub end"). Notch 35 is preferably cut into the hub end for reasons which will be explained shortly.

At least one display element is located in or on the blade, such as on the blade's downward facing surface. The term "display element" is intended to broadly encompass any light emitting device capable of variations such as switching on and off, changing color, etc. In the present state of technology, such display elements are typically light emitting diodes ("LED's"). However, many other existing and yet to be developed display elements could be substituted for the LED's.

The display elements are attached to the blade body in any suitable fashion. In the embodiment shown, display elements 18 are surface mounted on display board 16 (which may be a printed circuit board). Display pocket 14 is provided to receive display board 16 so that it lies flush with the downward facing surface of blade body 12.

Display board 21 may incorporate other elements needed to optimize the operation of the display elements, such as chip resistors and integrated circuit boards. In the example shown, an integrated circuit known as a "driver" (driver 21) is shown. The upward facing surface of display board 16 mounts female connector 20. This is preferably a multi-pin plug-type connector having multiple electrically independent conductors. Female connector 20 forms one part of a two part mating electrical connector. The embodiment show illustrates a female connector being located proximate the hub end of the blade body. A male connector could be substituted, so the relative location of the male component and the female component is properly viewed as arbitrary.

The reader will note that notch 16 allows clearance for female connector 20 when display board 16 is placed in display pocket. The display board is held in place by any suitable means, including a press fit, a dovetail engagement, snaps, fasteners, adhesives, and the like.

Figure 2:
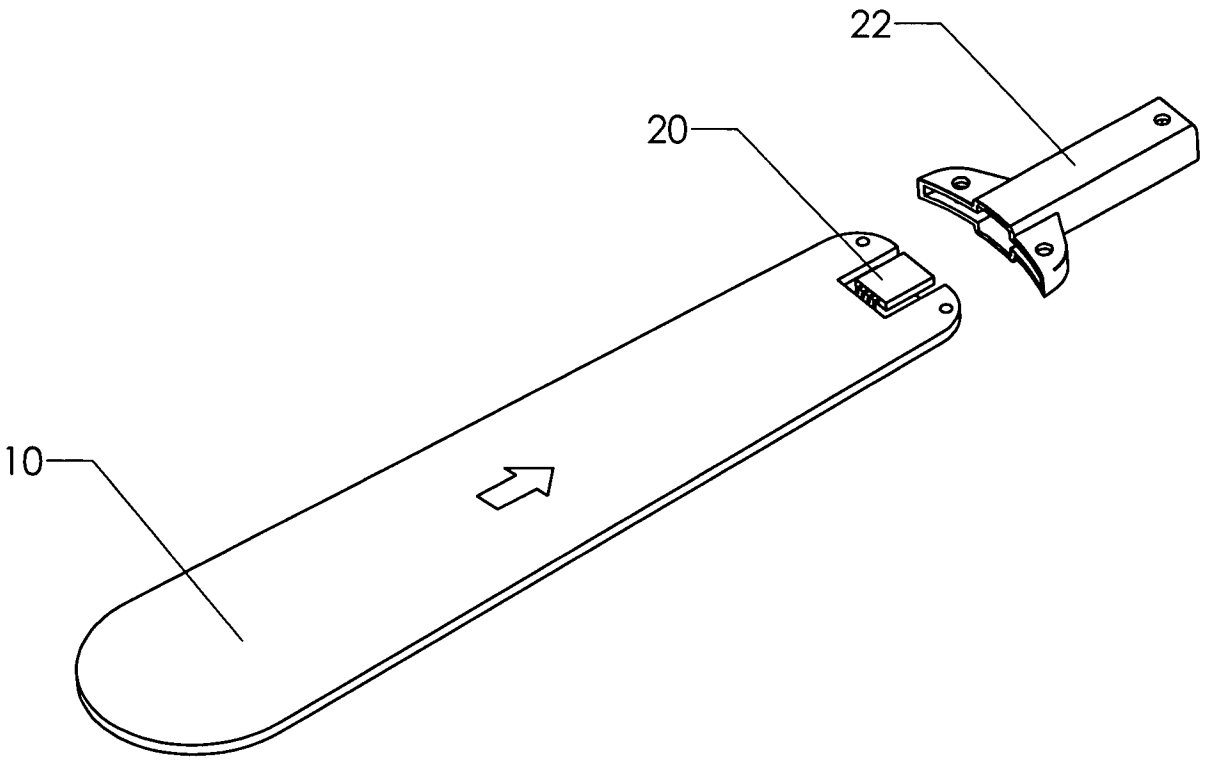
FIG. 2 is a perspective view, showing the joining of a blade assembly with a yoke.
Figure 3:
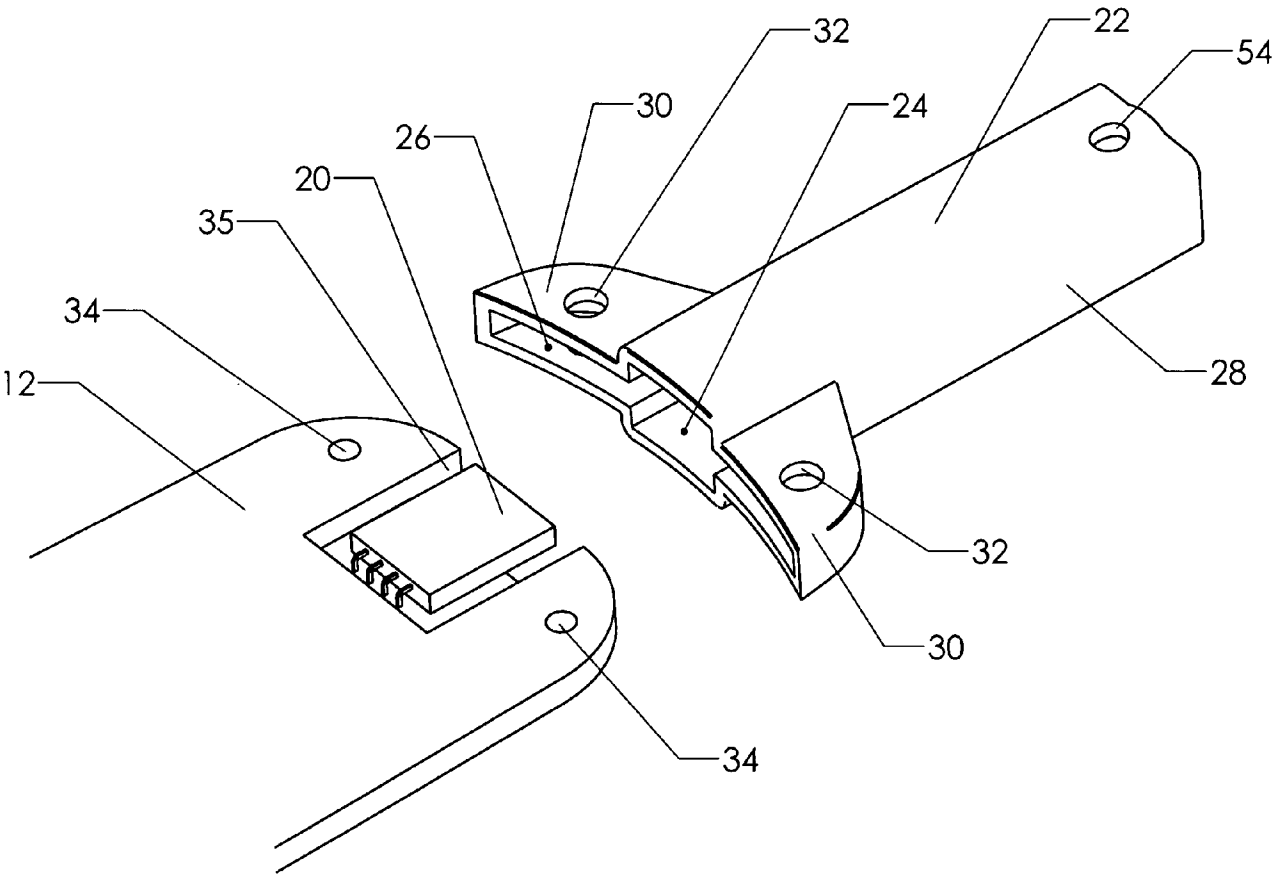
FIG. 3 is a detailed perspective view, showing details of the yoke.

FIG. 2 shows blade assembly 10 after the display board has been attached. Female connector 20 rests in notch 35 on the hub end of the blade. Yoke 22 is configured to provide the mechanical connection means between the blade assembly and the hub. FIG. 3 shows yoke 22 and blade body 12 in more detail. Yoke 22 includes an elongated receiver 28 with a pair of wings 30 extending laterally outward. The wings and the receiver preferably include a hollow interior. Pocket 26 is sized to slidably receive blade body 12, while connector receiver 24 is sized to receive female connector 20.

A pair of through holes 32 in the wings 30 are positioned to align with a corresponding pair of through holes 34 in blade body 12, so that securing pins can be placed in the aligned holes. The portion of yoke 22 extending toward the hub includes cross latch hole 54, the purpose of which will be explained subsequently.

The yoke may be joined to the blade body by any suitable means. It is desirable to minimize the weight of the assembly, such as by using fiber reinforced composites for the blade body. If this is the case, it is advantageous to use a high-strength adhesive to bond the blade body to the yoke (such as a cross-linking adhesive).

Figure 4:
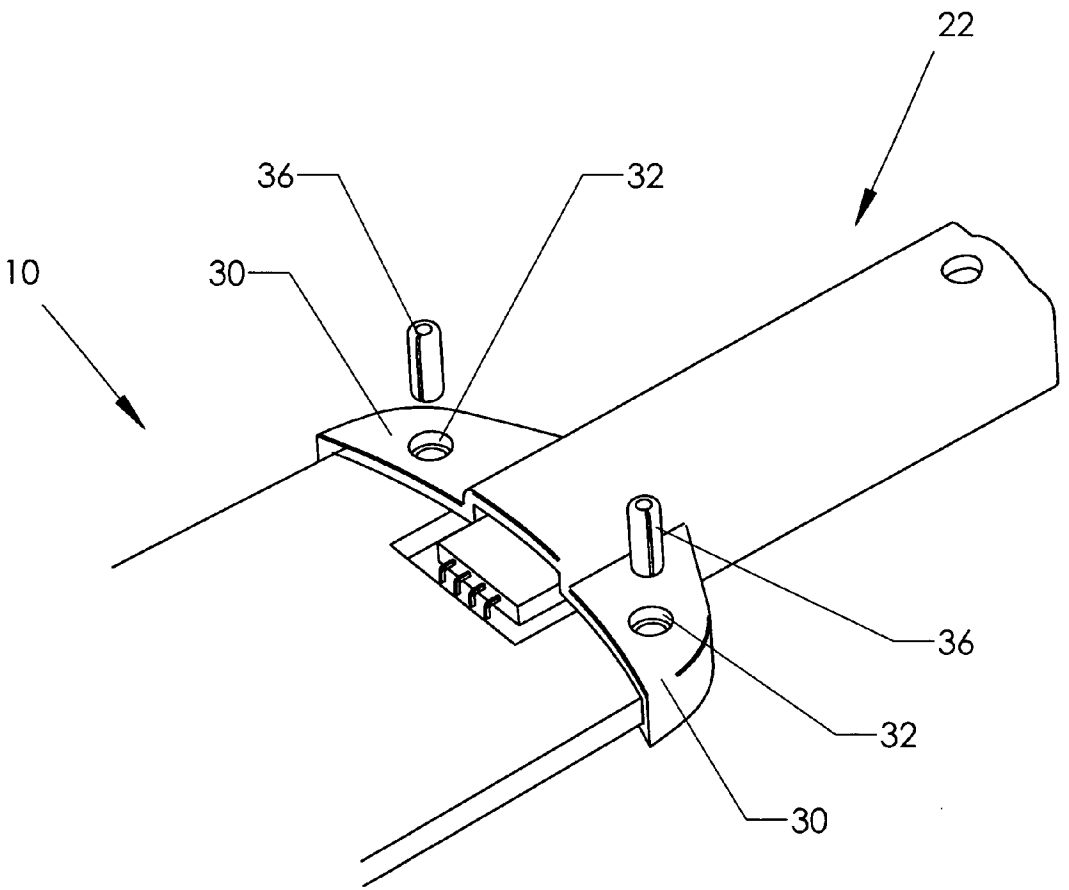
FIG. 4 is a detailed perspective view, showing the addition of two lock pins.

FIG. 4 shows blade assembly 10 after it has been joined to yoke 22. Those skilled in the art will know that adhesive joints may suffer from cyclic fatigue. It may therefore be desirable to add another linking element. In this case, lock pins 36 are press fit into the aligned through holes 32. Other types of fasteners could obviously be substituted and the version shown in FIG. 4 should properly be viewed as only one example among many possibilities.

The assembly of the yoke and the blade assembly is preferably done in the manufacturing process before the product is shipped to a consumer. Because ceiling fans are relatively bulky, it makes sense to have some assembly done at the installation site. However, it is preferable to minimize the tools required for this process—and even more preferable to eliminate tools altogether.

Figure 4B:
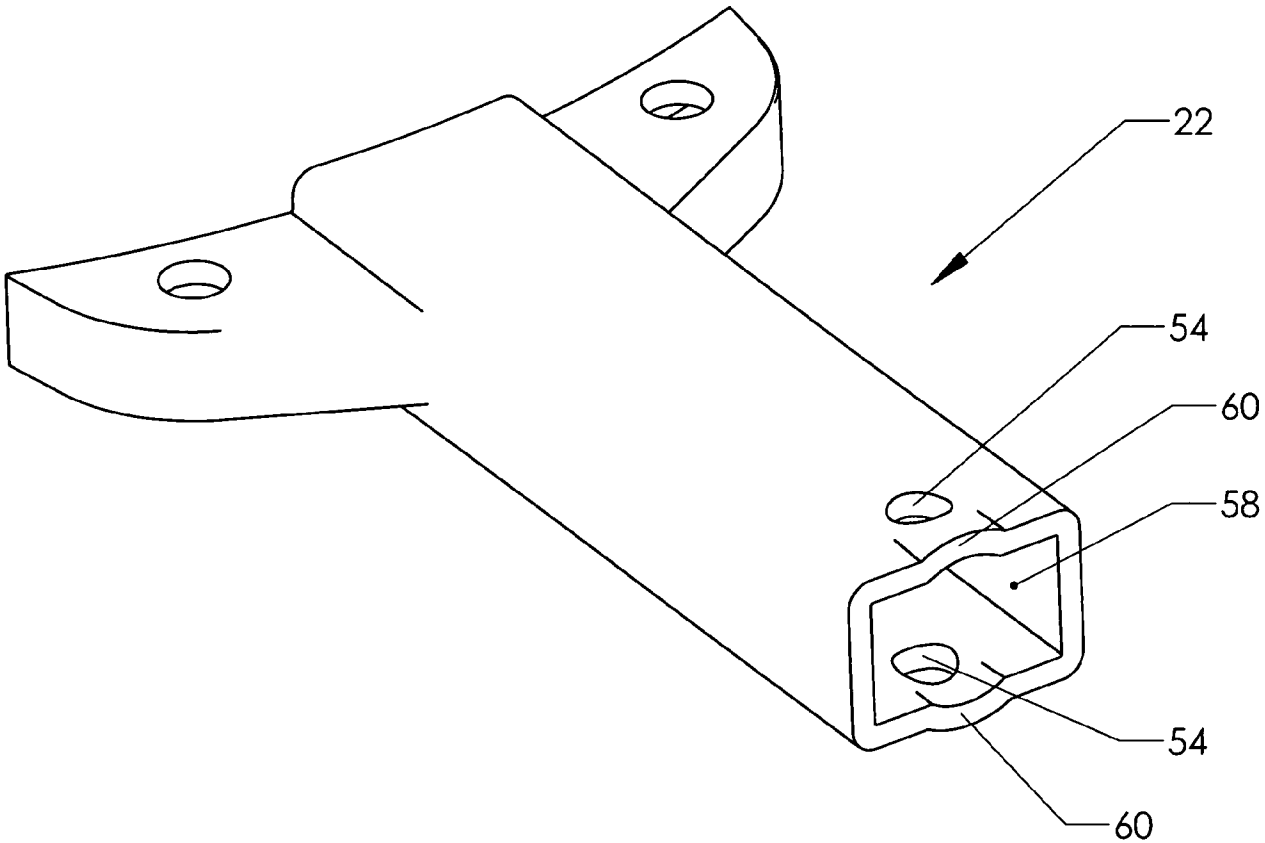
FIG. 4B is a perspective view, showing more features of the yoke.

To that end, it is desirable to provide a mechanical connection between the blade assembly and the hub of the ceiling fan which slides into place and which requires no tools to install. Yoke 22 is the first part of a mating mechanical connector. FIG. 4B shows the opposite side of yoke 22 (the side facing the hub). A mating mechanical connector can assume a virtually endless variety of forms. In the embodiment of FIG. 4B, hollow interior 58 is intended to slidably receive the second part of the mating mechanical connector.

Cross latch hole 54 is positioned to receive a cross latch (not shown) which locks the two parts of the mating mechanical connector together. Two latch guides 60 are provided. These are tapering channels which lead the cross latch into engagement with the two cross latch holes.

Figure 5:
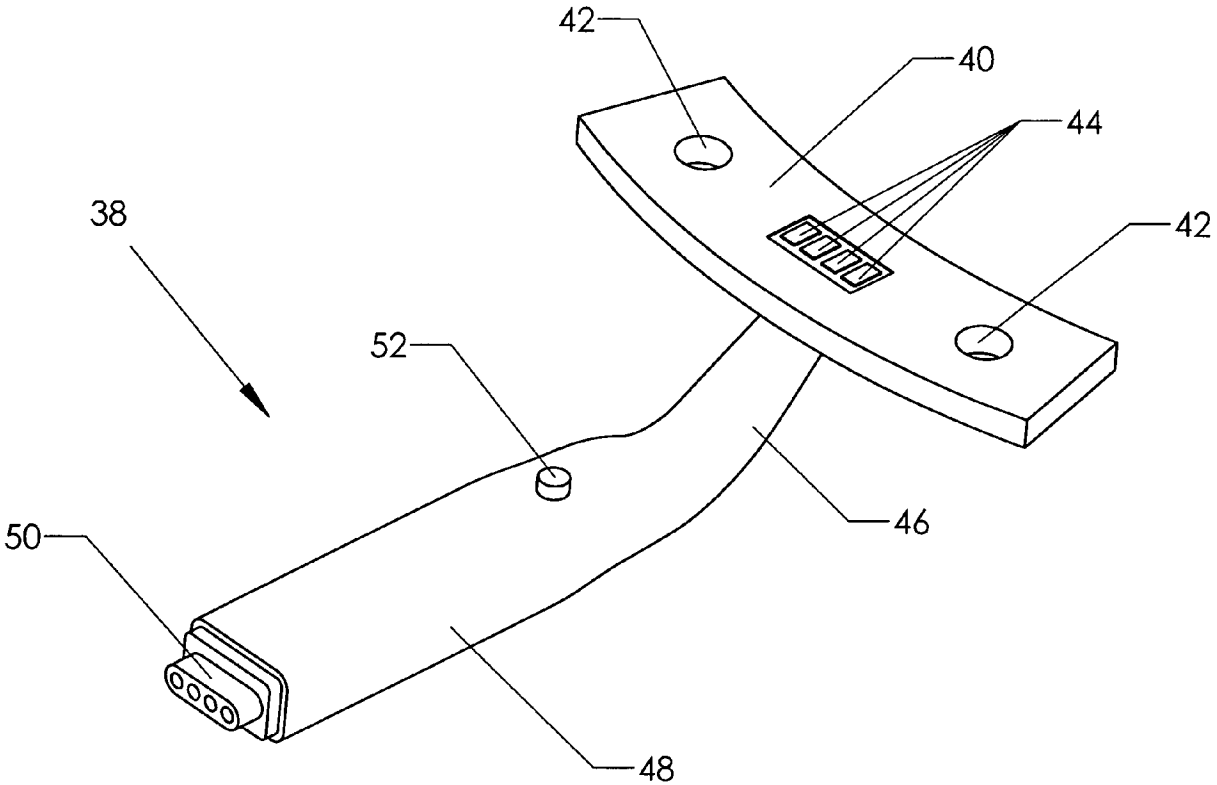
FIG. 5 is a perspective view, showing a stem assembly used to attach the blade assembly to a hub.

FIG. 5 shows the second part of the mating mechanical connector. Mating bar 48 is configured to slidably engage hollow interior 58 of yoke 22. Cross latch 52 is a spring biased cylindrical device which is housed within the mating bar. It includes two spring-biased protrusions which pop outward (extending upward and downward in the orientation shown in the view). The protrusions preferably include filleted upper and lower edges as shown. This type of device will be familiar to those skilled in mechanical design and particularly those familiar with locking two-piece kayak paddles, which include the same type of cross latch. The user may easily press the protrusions back into the mating bar, but they will extend on their own when released.

The mating bar can incorporate any number of features traditionally used to attach a fan blade to a hub. In the example shown, mounting plate 40 actually attaches to the hub by passing a pair of bolts through the two mounting holes 42 and into the hub. Drop arm 46 connects mating bar 48 to mounting plate 40, providing an appropriate vertical offset.

The present invention establishes both an electrical and a mechanical connection when attaching the blade assembly. Thus, the mating bar also includes an electrical connector—male connector 50. This is positioned to mate with female connector 20 when mating bar 48 slides into hollow interior 58 in the yoke 22. As mentioned previously, the placement of the male side of the mating electrical connector on one side or the other of the mechanical connector is arbitrary. Likewise, the placement of the male side of the mechanical connector on the component attached to the fan blade as opposed to the portion attached to the hub is again arbitrary.

The components shown in FIG. 5 are collectively referred to as stem assembly 38. The electrical signals transmitted through male connector 50 must typically be brought to the hub—where a controller is likely positioned. In this example, four separate conductors are contained within male connector 50. Each conductor is connected via a wire passing through the interior of the stem assembly to a contact 44 on the upward facing surface of mounting plate 40. These contacts 44 touch spring loaded corresponding contacts on the hub itself. Thus, a complete circuit is made from the fan blade to the hub. Many other types of connectors and contacts could be substituted to achieve the same purpose.

Figure 6:
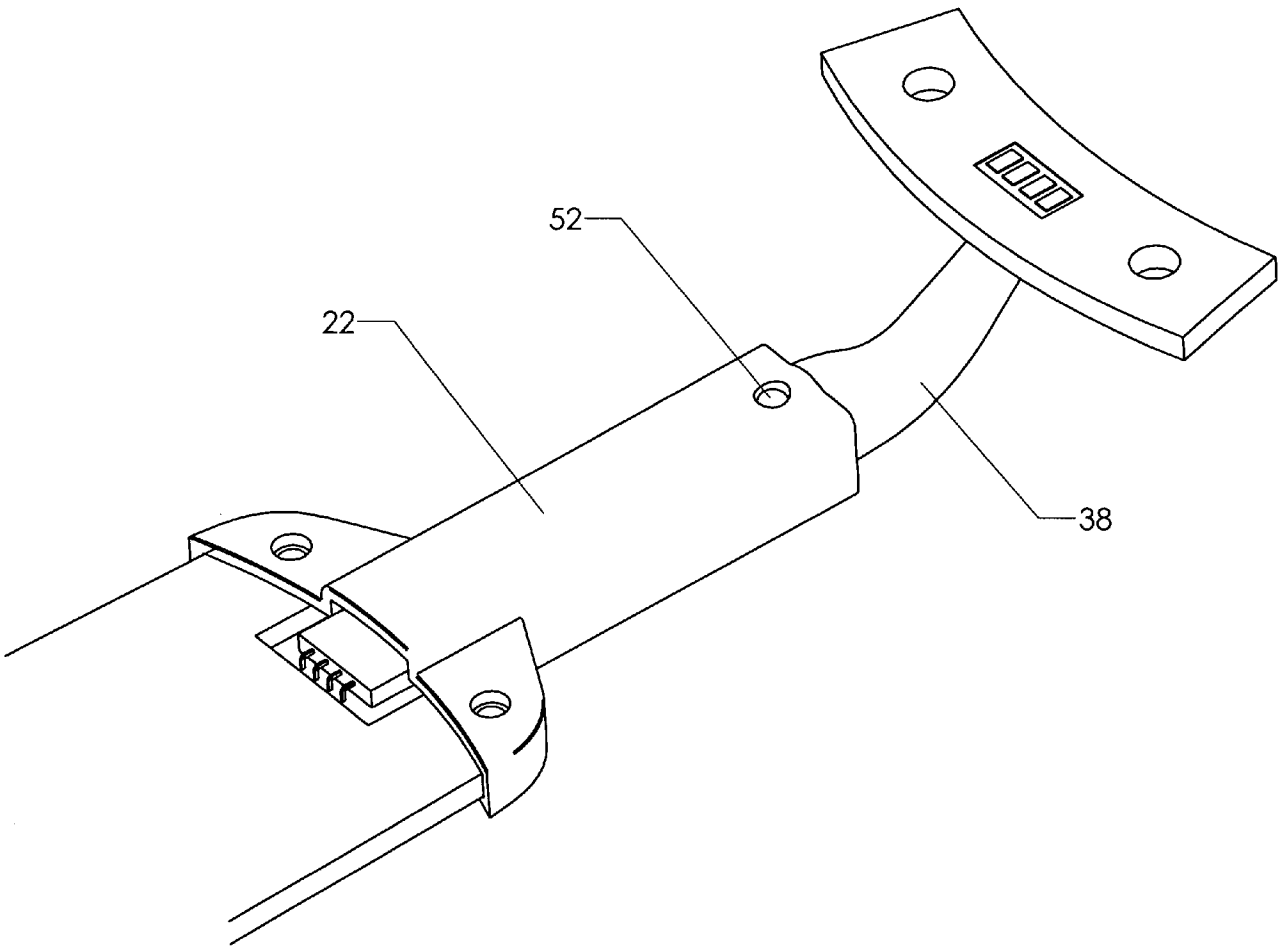
FIG. 6 is a perspective view, showing the blade assembly attached to a stem assembly.

FIG. 6 shows yoke 22 slidably engaged with stem assembly 38. Cross latch 52 has engaged cross latch hole 54 in yoke 22. The yoke and the mating bar are thereby locked together. They cannot slide further together or slide apart. The mechanical shape of the mating parts is preferably configured to rotationally lock the parts together. In the example shown, a roughly rectangular cross section is used. Thus, the mating parts cannot rotate with respect to each other, even in the absence of cross latch 52. This is a preferred feature where rapid pitching forces are applied to the fan blades. However, the invention can certainly be implemented using an engagement that permits rotation without the use of a cross latch or other locking feature.

Figure 7:
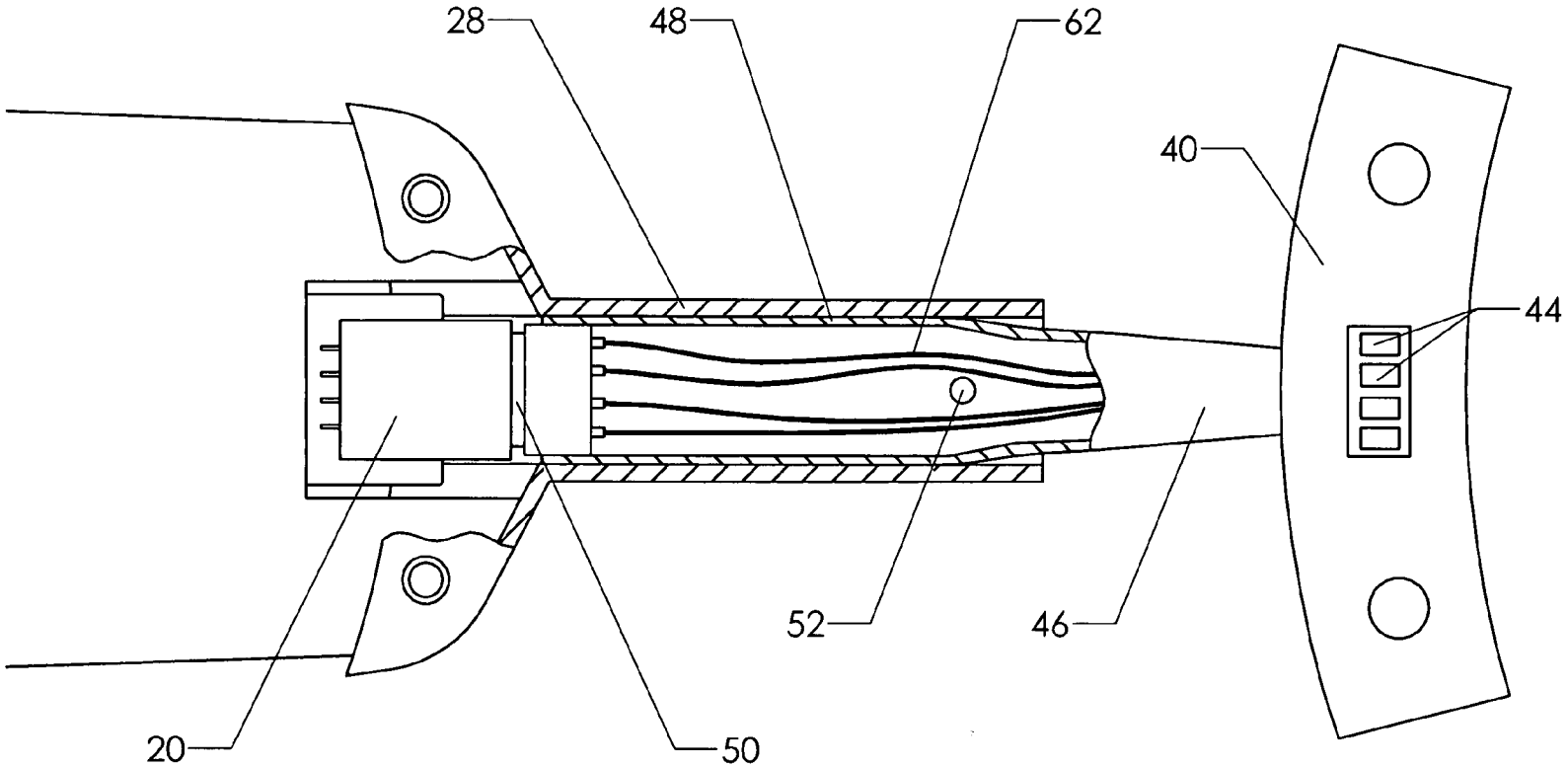
FIG. 7 is a plan view including a sectional cutaway, showing some internal details of the connections depicted in FIG. 6.

FIG. 7 shows an elevation view with a partial cutaway to reveal interior features. The reader will observe that the two parts of the mating mechanical connector (receiver 28 and mating bar 48) have been slidably engaged and locked in position using cross latch 52. Likewise, female connector 20 has been mated with male connector 50. Four wires 62 leading from male connector 50 to contacts 44 are shown. Of course, the female connector is attached to the display elements via the display element board. The electrical connector preferably incorporates tapered engaging surfaces to facilitate the mating process.

Once mounting plate 40 is attached to the hub, a complete electrical circuit is created from the display elements to the hub. The reader will thereby perceive that the simple motion of sliding the blade assembly in toward the hub has mated the two parts of the mating mechanical connector and the two parts of the mating electrical connector. Cross latch 52 is guided into the cross latch holes 54 in the yoke and pops into place because of its internal compression springs. Thus, as the user pushed the blade assembly in toward the hub, the electrical and mechanical connections are completed automatically. No tools are needed.

It is important that the mating mechanical connectors and the mating electrical connectors move in unison during the mating process. However, it is not particularly important how they are connected to each other. The connection can be direct or through numerous intermediate components. As an example, it is important that the female electrical connector move in unison with the yoke. It could be attached directly to the yoke or—as in the examples provided—connected to a display board which is connected to the blade body which is connected to the yoke.

Figure 8:
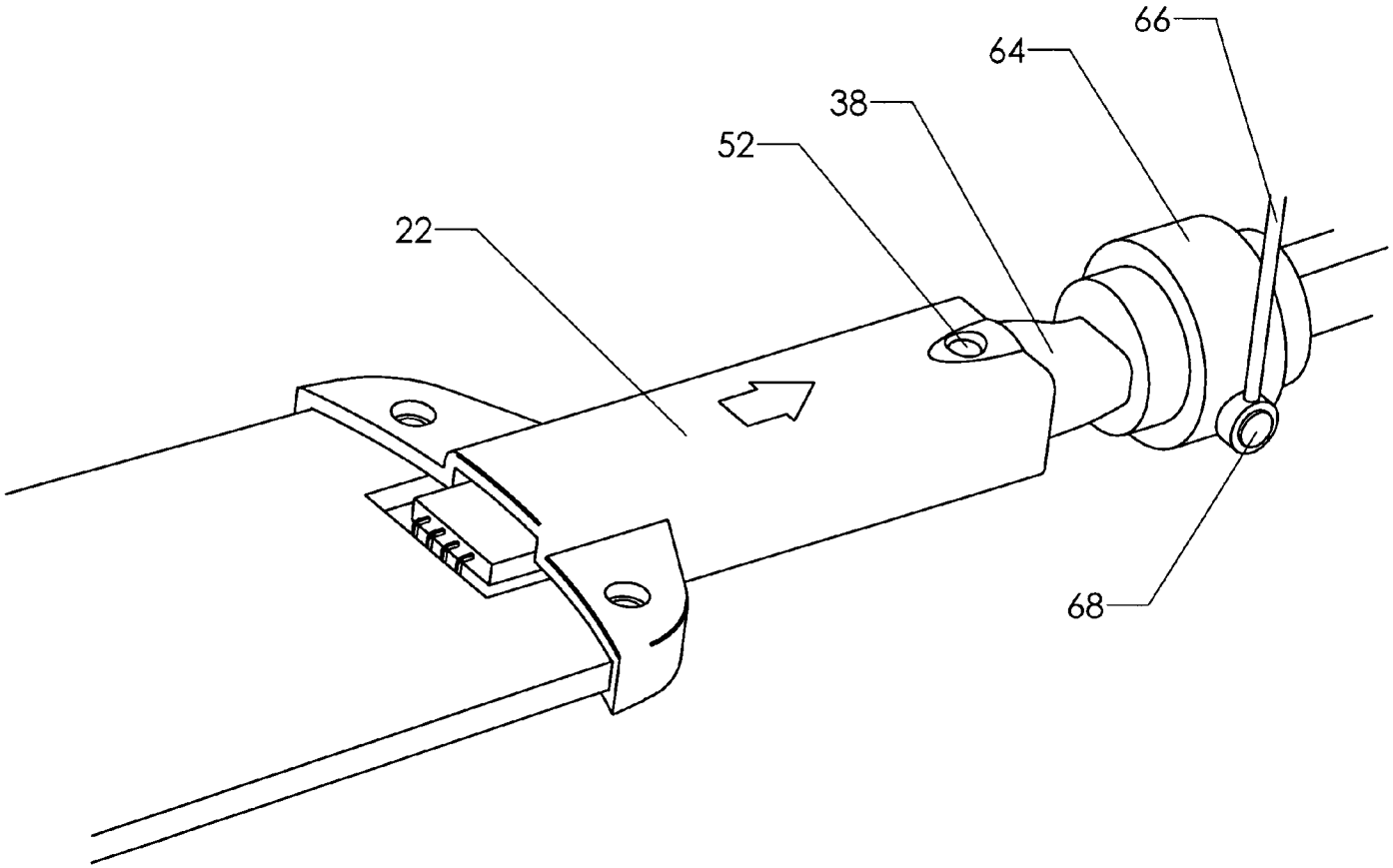
FIG. 8 is a perspective view, showing the use of the invention for connection to a stem assembly including a pitch joint and a pitch actuator.

The resulting connections are quite robust. The mechanical joint is well suited to carry the bending and torsional loads inherent in its operation. The electrical connection is isolated from these loads—as the mechanical structure passes around and envelops the electrical connection. FIG. 8 shows the joint assembly attached to a different type of stem assembly 38. This type of stem assembly is designed to apply rapid pitch changes to the fan blades—such as are needed to use the fan as a low frequency audio transducer.

Pitch joint 64 allows the stem assembly to rotate about the pitch axis. Pitch actuator 66 is connected to the stem assembly side of the pitch joint via ball joint 68. The pitch joint is connected to a cyclic actuating mechanism such as a swash plate. In this configuration, the pitch may be changed 30 or more times per second. The robust mechanical and electrical connections provided by the present invention permit such operation.

Although the preceding description contains significant detail, it should not be construed as limiting the scope of the invention but rather as providing illustrations of the preferred embodiments of the invention. As an example, the female electrical connector can be attached directly to the blade body instead of a separate display board. As a second example, the display board could be placed on the upward facing side of the fan blades in order to project patterns on the ceiling. The inventive device could be realized in many different ways. Thus, the scope of the invention should be fixed by the following claims rather than the examples given.

Having described our invention, we claim:

1. A fan blade assembly for facilitating an electrical connection and a mechanical connection between a fan blade and a revolving hub on a ceiling fan, comprising:

a. a blade body having a hub end and a tip end;

b. at least one electrical display element located on said blade body;

c. a first part of a mating mechanical connector attached to said blade body proximate said hub end;

d. a first part of a mating electrical connector connected to said first part of said mating mechanical connector;

e. a second part of said mating mechanical connector attached to said hub;

f. a second part of said mating electrical connector attached to said mating mechanical connector; and g. wherein said first and second mating parts of said mating mechanical connector and said first and second parts of said mating electrical connector are configured such that engaging said mating mechanical connector simultaneously engages said electrical connector.

2. A fan blade assembly as recited in claim 1, wherein said first part of said mechanical connector is configured to slidably engage said second part of said mechanical connector.

3. A fan blade assembly as recited in claim 2, wherein said slidable engagement is configured to occur as said fan blade is moved inward toward said hub.

4. A fan blade assembly as recited in claim 3, further comprising a cross latch which selectively locks said first and second mechanical connector in said slidable engagement.

5. A fan blade assembly as recited in claim 1, wherein said mating electrical connector includes multiple independent conductors.

6. A fan blade assembly as recited in claim 2, wherein one of said first and second parts of said mating mechanical connector includes a hollow interior sized to slidably receive the other of said first and second parts of said mating mechanical connector.

7. A fan blade assembly as recited in claim 6, further comprising a cross latch which selectively locks said first and second mechanical connector in said slidable engagement.

8. A fan blade assembly as recited in claim 7, wherein said mating electrical connector includes multiple independent conductors.

9. A fan blade assembly as recited in claim 6, wherein said hollow interior encloses one of said first and second parts of said mating electrical connector.

10. A fan blade assembly as recited in claim 2, wherein said first and second parts of said mating mechanical connector are configured so that said slidable engagement rotationally locks said first and second parts together.

11. A fan blade assembly for facilitating an electrical connection and a mechanical connection between a fan blade and a revolving hub on a ceiling fan, comprising:

a. a blade body having a hub end and a tip end;

b. at least one electrical display element located on said blade body;

c. a yoke attached to said hub end;

d. a stem assembly attached to said hub;

e. wherein said yoke is configured to slidably engage said stem assembly;

f. a latch for latching said yoke and said stem assembly in said slidable engagement;

g. a first part of a mating electrical connector connected to said at least one electrical display element;

h. a second part of said mating electrical connector attached to said stem assembly; and i. wherein said yoke, said stem assembly, and said first and second parts of said mating electrical connector are configured such that engaging said yoke and said stem assembly simultaneously engages said electrical connector.

12. A fan blade assembly as recited in claim 11, wherein said yoke and said stem assembly are configured such that slidably engaging said yoke and said assembly also rotationally locks said yoke and said stem assembly together.

13. A fan blade assembly as recited in claim 12, wherein said slidable engagement is configured to occur as said fan blade is moved inward toward said hub.

14. A fan blade assembly as recited in claim 13, further comprising a cross latch which selectively locks said yoke and said stem assembly in said slidable engagement.

15. A fan blade assembly as recited in claim 11, wherein said mating electrical connector includes multiple independent conductors.

16. A fan blade assembly as recited in claim 12, wherein said yoke includes a hollow interior sized to slidably receive at least a portion of said stem assembly.

17. A fan blade assembly as recited in claim 16, further comprising a cross latch which selectively locks said yoke and said stem assembly in said slidable engagement.

18. A fan blade assembly as recited in claim 17, wherein said mating electrical connector includes multiple independent conductors.

19. A fan blade assembly as recited in claim 16, wherein said hollow interior encloses one of said first and second parts of said mating electrical connector.

20. A fan blade assembly as recited in claim 12, wherein said mating electrical connector includes multiple independent conductors.

* * * * *